US005436975A

United States Patent [19]

Lowe et al.

[11] Patent Number: 5,436,975

[45] Date of Patent: Jul. 25, 1995

[54] APPARATUS FOR CROSS FADING OUT OF THE HEAD SOUND LOCATIONS

[75] Inventors: Danny D. Lowe; Simon Williams; Terry Cashion, all of Calgary, Canada

[73] Assignee: QSound Ltd., Calgary, Canada

[21] Appl. No.: 190,456

[22] Filed: Feb. 2, 1994

[51] Int. Cl.[6] ..... H04R 5/00

[52] U.S. Cl. ..... 381/17; 381/63

[58] Field of Search ..... 381/63, 17

[56] References Cited

U.S. PATENT DOCUMENTS 4,817,149 3/1989 Myers ..... 381/63

5,052,685 1/1991 Lowe ..... 381/17

*Primary Examiner*—Curtis Kuntz

*Assistant Examiner*—Minsun Oh

*Attorney, Agent, or Firm*—Jay H. Maioli

[57] ABSTRACT

A system for use with headphones provides sound imaging positioning that can accurately locate the sound image at any one of a number of points surrounding the listener and can smoothly fade the sound position from one point to the next as the apparent sound source moves relative to the listener during panning. Individual sound positioners are provided that include only scalers or delay lines are provided for each channel, so that the same sound location filters can be utilized with a number of voices or input channels.

16 Claims, 3 Drawing Sheets

APPARATUS FOR CROSS FADING OUT OF THE HEAD SOUND LOCATIONS

BACKGROUND OF THE INVENTION

1. Field of the Invention

This invention relates generally to a sound image processing for positioning audio signals being reproduced over headphones and, more particularly, to apparatus for panning the apparent sound location so that it appears to move relative to the listener with smooth transitions during the panning operation.

2. Description of the Background

Although a number of schemes have been proposed for providing sound image positioning during playback over two or more loudspeakers, only recently has such sound image positioning been proposed for headphone use. Different sound processing techniques are required for the headphone reproduction in view of the human hearing mechanism.

One approach for providing accurate sound image placement during reproduction over headphones is disclosed in U.S. patent application Ser. No. 08/069,870 filed Jun. 1, 1993 and assigned to the assignee of this application. The disclosure in the above-identified application is incorporated herein by reference. In the system of that application, front and back sound location filters are provided, and it is possible to pan from left to right through 180° using the front filter and then from right to left through 180° using the rear filter. A number of scalers are provided at the filter inputs and/or outputs to adjust range and location of the apparent sound source. Thus, a large number of circuit components and filtering power is required to provide a realistic sound image placement and to provide movement of the sound image location using the front and back filters, a pair of which are required for the left and right ears. In addition, in the previously proposed system, there is a certain granularity in the sound as the sound position is stepped around the various azimuth locations relative to the listener. Such sound position increments can sometimes be heard and are annoying. Thus, previous systems do not permit a smooth fading between the various sound origin positions.

Therefore, a sound positioning system for use with headphones that can provide a smooth transition between locations as the apparent sound location is panned relative to the listener is quite desirable. In addition, a system with a reduced number of components but can still provide capability for panning a number of channels or voices is highly desirable.

OBJECTS AND SUMMARY OF THE INVENTION

Accordingly, it is an object of the present invention to provide an apparatus for processing audio signals for playback over headphones in which the apparent sound location can be smoothly panned over a number of locations relative to the headphone listener and that does not require a large number of circuit components to accomplish this result.

It is another object of the present invention to provide an apparatus for reproducing audio signals over headphones in which side filters are provided in addition to front and back filters, so as to more accurately locate the apparent sound source relative to the headphone listener.

It is another object of the present invention to provide an apparatus for reproducing audio signals over headphones in which a general filter arrangement is provided that can operate with a number of sound positioners, which correspond to the different voices or channels input to the headphone playback system.

In accordance with an aspect of the present invention, a filter network is provided for producing different azimuth locations or sound image placements in conjunction with early reflection filters in the form of stereo delay lines that can be used with a number of individual sound positioners each corresponding to a different voice or audio input channel.

Another aspect of the present invention involves providing a plurality of sound positioners each including only scalers, multipliers or delay lines but no filters, so that the sound placement filter arrangement can be viewed as a universal filter arrangement relative to the plurality of sound positioners providing inputs thereto.

The above and other objects, features, and advantages of the present invention will become apparent from the following detailed description of illustrative embodiments, to be read in conjunction with the accompanying drawings in which like reference numerals represent the same or similar elements.

DETAILED DESCRIPTION OF PREFERRED EMBODIMENTS

Figure 1:
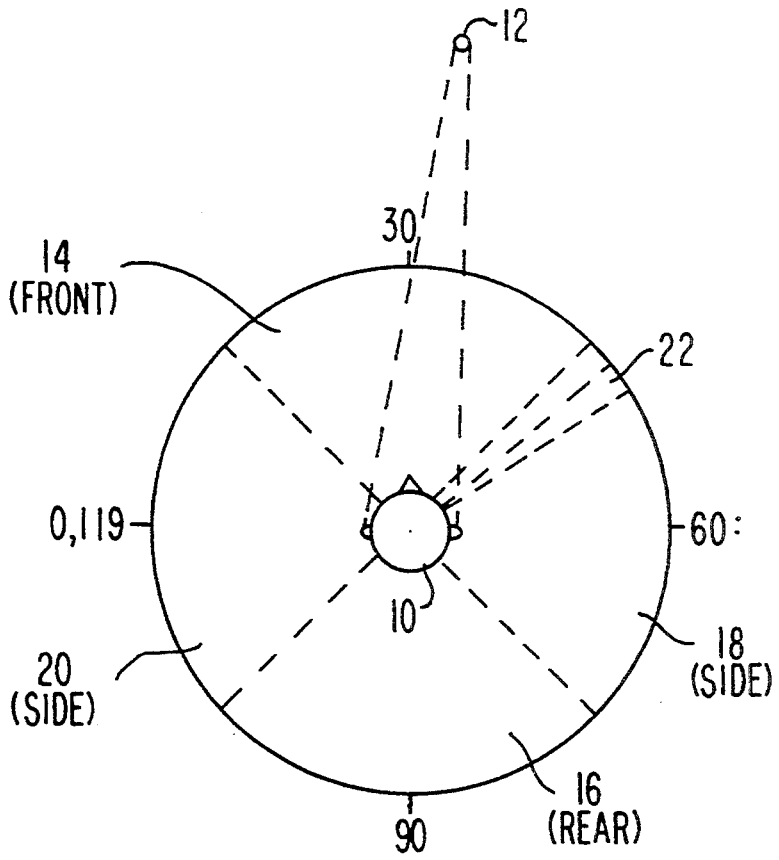
FIG. 1 is a diagrammatic representation of a listener relative to a sound source showing various positions for that sound source.

The present invention relates to a panning technique in which an apparent sound location is made to move relative to a person listening to the sound signals being reproduced over headphones. The present invention provides a system that permits the apparent sound source location to occupy generally any point on a circle surrounding the listener and to be panned successively through such points. FIG. 1 represents the listener generally at 10 and the listener is assumed to be listening to reproduced signals over headphones and assuming a standard stereo program, the listener 10 would perceive the typical sound source to be located at 12, that is, directly in front of him. In the present embodiment, the circle showing the locus of possible sound source locations is arbitrarily divided into 120 positions, with the origin or zero position at the left side and proceeding clockwise around the listener 10 so that the position 30 is directly in front, position 90 is directly behind and position 0 or 119 and 60 are at the respective sides of the listener 10. The circle surrounding the listener can be divided into quadrants corresponding to front 14, rear 16, left side 18, and right side 20. These quadrants have a relation to the filters that will be used in positioning the sound source generally.

In following the present invention, the apparent location of the sound source 12 can be made to move relative to the headphone listener 10 and a feature of the present invention is to provide a smooth transition or fade between the respective quadrants, and such a transition zone is shown cross-hatched at 22 as representing a transition between the front quadrant 14 and the right-side quadrant 18. It should be understood, of course, that the circle surrounding the listener can be divided into any number of increments different than 120 and that more sections exceeding the four quadrants could also be provided in keeping with the present invention. Furthermore, the radial distance extending from the listener 10 corresponds to so-called range, that is, the distance of the apparent sound location from the listener 10.

Figure 2:
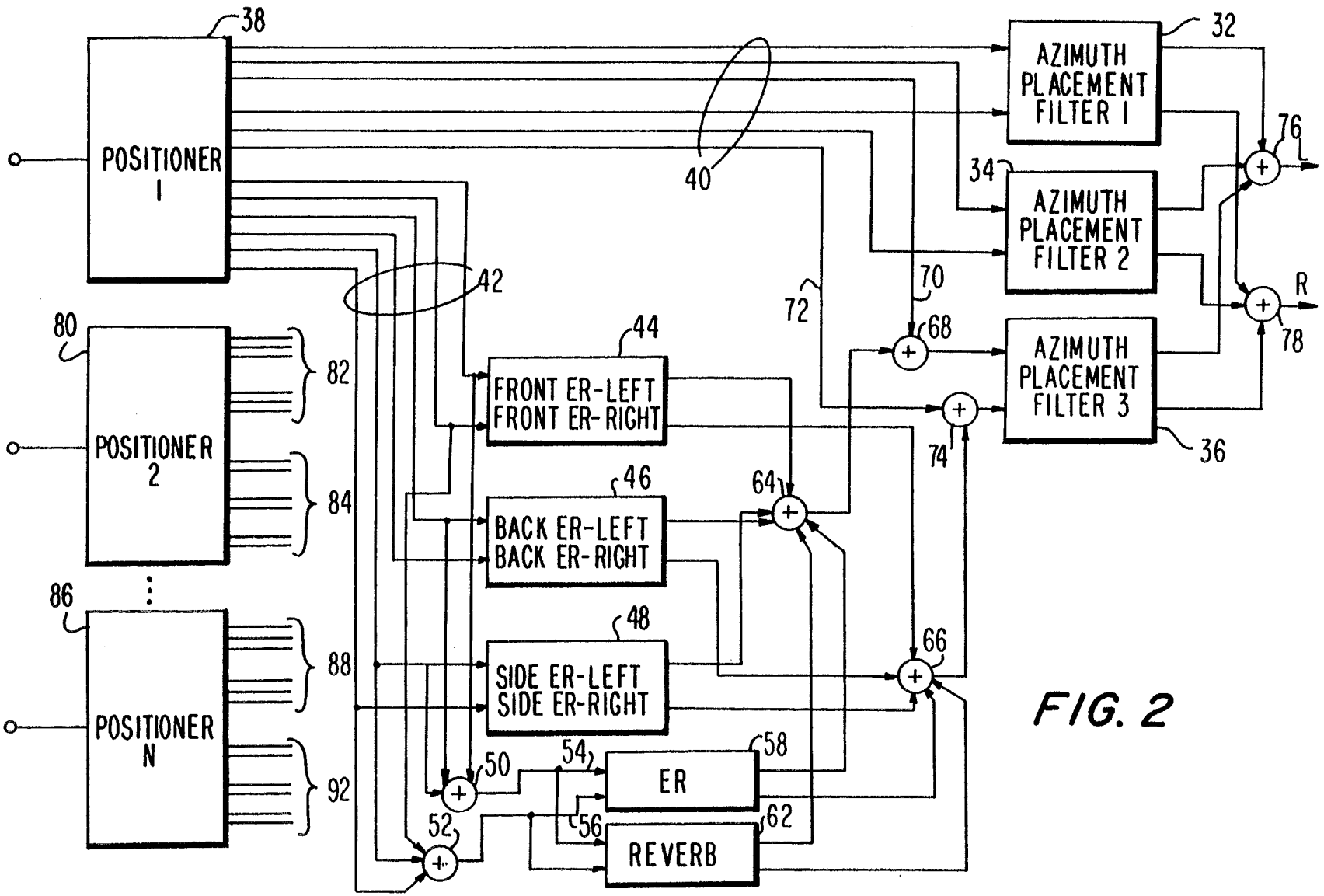
FIG. 2 is a schematic in block diagram form of a headphone processing system according to an embodiment of the present invention.

FIG. 2 represents an embodiment that provides the apparent sound source location at any one of the 120 azimuth positions of FIG. 1, each having many possible range positions.

In the system described in the above-identified patent application, which is incorporated herein by reference, front and back filters are provided each of which can provide a sound placement over 180°. On the other hand, the present invention provides filters for front and back and two sides, thereby providing greater positional accuracy in the placement of the sound origin. For example, an azimuth placement filter 32 might provide the front quadrant sound source location and a second azimuth placement filter 34 might provide the rear sound source location. Although two side quadrants are shown in FIG. 1, these quadrants can be accommodated by only a single azimuth placement filter 36. Because the human hearing process can be deemed to be similar with respect to the left ear and right ear, in a low-cost version of the inventive system, only a signal side placement filter is required for one side and the alternate side can be obtained by inversion.

In the system described in the above-identified patent application, there are a number of scalars and the like that are incorporated into the system and that are arranged following the various placement filters, for example. On the other hand, the present invention provides a universal filter system that can accommodate a number of positioners corresponding to each channel or voice. For example, a first positioner 38 provides signals to the azimuth placement filters 32, 34, and 36 on six lines shown generally at 40. These six lines represent the left and right signals for the front, back, and side placements. Details of the positioner 38 and the manner in which the output signals are derived from a single input signal will be explained in relative to FIG. 3. Nevertheless, it should be noted that the six lines 40 represent so-called unranged signals, that is, signals that relate solely to the actual sound location regardless of the distance of the apparent sound source from the listener. On the other hand, positioner 38 also produces so-called ranged signals, as will be explained relative to FIG. 3, on six additional signal lines shown generally at 42. These six lines correspond to the left and right signals for the front, back, and side placements and are fed to units that correspond to early reflection filters.

As explained in the above-identified pending patent application typical sound waves produced by any type of sound source in a room that reach the ear's of a listener consist of three portions, a direct wave portion which would correspond to the above unranged signals, an early reflection portion that is made up of number of signals that bounce off the walls, ceiling, and floor before reaching the ears of a listener, and a third portion which is a so-called reverberation which is the multiple reflections of the sound as they bounce around inside the room before the sound ultimately decays. Therefore, the so-called early reflection filters provide the majority of information concerning the distance of the sound source from the listener.

Figure 4:
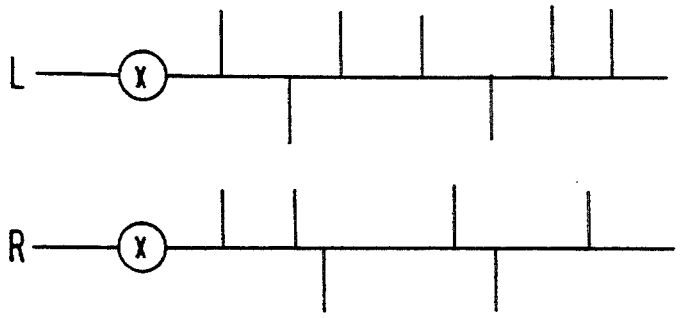
FIG. 4 is a representation of a stereo delay line as might be incorporated in the embodiment of FIG. 2.

A front early reflection filter is provided at 44, a back early reflection filter is provided at 46, and a side early reflection filter is provided at 48. Thus, the front early reflection filter 44 receives front left and right signals from positioner 38, back early reflection filter 46 receives back left and right signals from positioner 38 and side early reflection filter 48 receives side left and right signals from positioner 38. It will be recalled that it is not necessary to provide left and right side signal processing, since inversion of the signal will accomplish the left to right swap. These early reflection filters 44, 46, 48 may be implemented by providing two delay lines each one having its own input signal, thus, forming a so-called stereo filter. The operation of such stereo filter is shown in FIG. 4 and will be explained herein-below.

As noted above the sound from a sound source reaching a listener in a room can be thought of as being formed of three portions. The third portion is a reverberation portion that is eventually damped out as the sound dies away. That portion has some ranging information contained in it so that the left and right output lines shown generally at 42 are respectively summed in summers 50 and 52 to form left and right summed ranged signals. Specifically, the line 54 consists of the left ranged signals and line 56 consists of the right ranged signals and these signals are fed to a pseudo-random sequence generator 58 that generates a pseudo sequence that corresponds to the multiple early reflections as they are reflected from the various surfaces of the room. Similarly, these signals on lines 54 and 56 are fed to a reverberation unit 62 that performs the standard type of reverberation processing corresponding to the diminished sound impulses reaching the listener from the walls of the room after a period of time.

The respective left outputs from the front filter 44, back filter 46, side filter 48, pseudo random binary sequence generator 58, and reverberation generator 62 are summed in signal summer 64 and the respective right outputs are summed in signal summer 66. The summed output signals from summer 64 are fed to signal summer 68 that receives at its other input an unranged side signal from positioner 38 on line 70. The output of signal summer 68 is then fed to the side azimuth placement filter 36. Similarly, the summed right output signal is fed to signal summer 74 whose other output is the right side unranged signal on line 72 from positioner 38. The output of signal summer 74 is then fed as the right side information to azimuth placement filter 36.

Therefore, it is seen that from this universal filter arrangement that the three portions of a sound signal known to be present are and produced by a positioner 38 are properly filtered. The actual left and right output signals are then summed respectively to produce the output signals fed to the headphone. More specifically, the left signals from the placement filters 32, 34, and 36 are summed in a signal summer 76 and the right signals are respectively summed in summer 78, thereby producing left and right output signals fed to the respective sides of the headphones.

As described above, the present invention is intended to provide a somewhat universal filter arrangement that can have a number of channels or voices fed in for sound location processing. The channels or voices might correspond to a number of voices produced by an audio synthesizer, for example. Thus, a second positioner 80 is provided whose six output signals 82 correspond to signals 40 from the first positioner 38 are to be connected to the azimuth placement filters 32, 34, and 36. The actual connections are not shown in order to simplify the drawing. Similarly, six ranged output signals are provided by positioner 80 at 84 and correspond to the eight ranged signals shown at 42 and are to be connected to the filters 44 through 48 and pseudo random binary sequence generator 58 and reverberation unit 62. The actual connections are not shown in order to simplify the drawings. Thus, the present invention can accommodate any number of positioners as represented by positioner 86 again having the two sets of output signals shown generally at 88 and 92.

Figure 3:
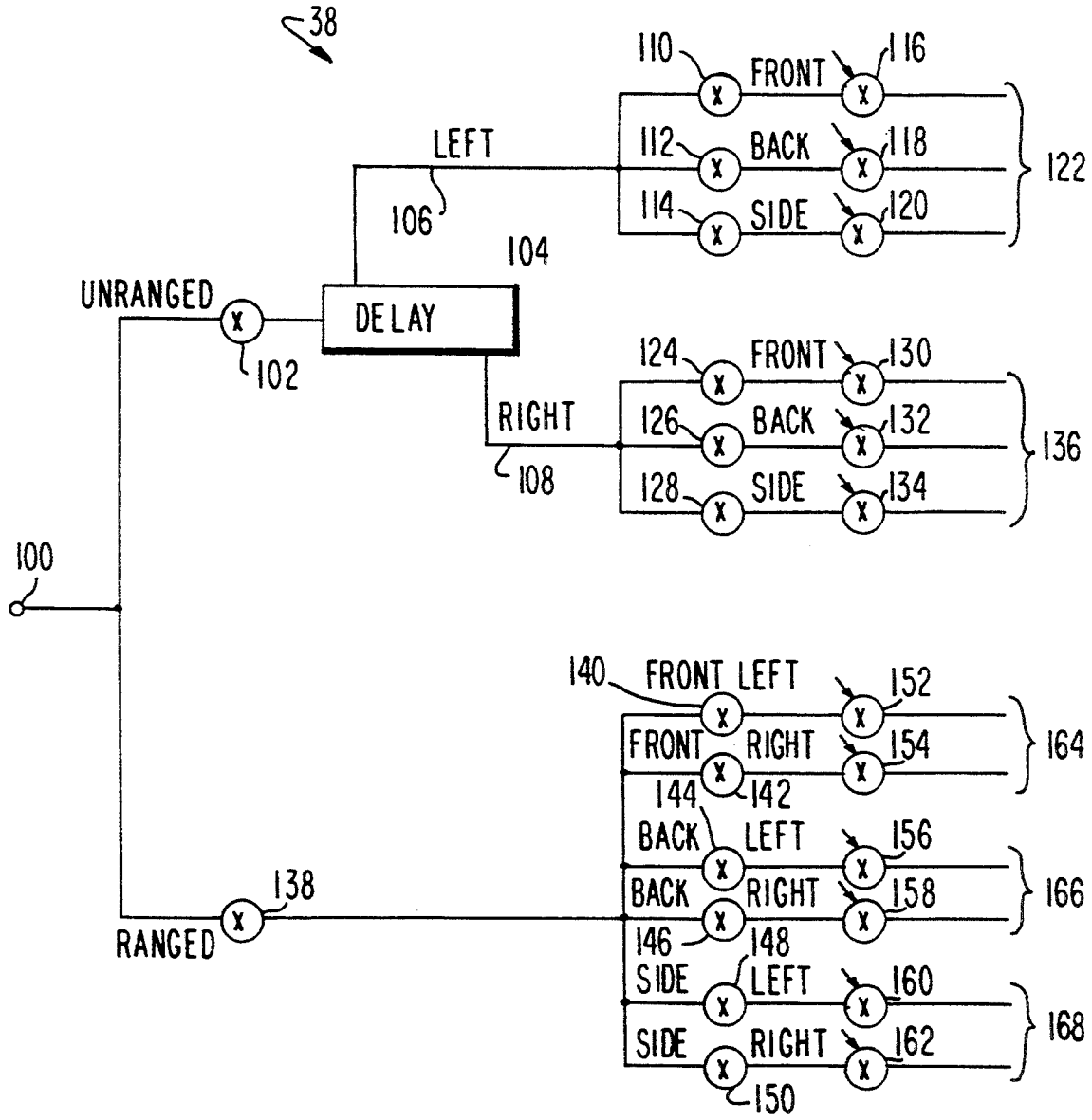
FIG. 3 is a schematic diagram of a positioner utilized in the embodiment of FIG. 2.

FIG. 3 shows one of the positioners 38, 80, or 86 in more detail. Specifically, a signal is input at 100 and is divided to form the unranged signals, such as 40 in FIG. 2, and the ranged signals, such as 42 in FIG. 2. As will be noted from FIG. 2, the so-called positioner produces six stereo output streams. A front, back, and side left and right representing unranged signals and a front, back, and side left and right representing ranged signals. In the embodiment of FIG. 3, the input signal at 100 is fed through a scaler 102 to a delay line 104 that separates the input signal into left and right channels. This is accomplished by selecting different taps in the delay line to produce the left and right signals. The left signal tap on line 106 is then fed to front, back, and side scalars and similarly the right signal on line 108 is also fed to the three respective scalars. Specifically, a left front scaler 110, a left back scaler 112, and a left side scaler 114 receive the left signal on line 106 and feed the appropriately scaled signals to variable scalers 116, 118 and 120. The outputs from the variable scalers are represented by the three lines shown generally at 122. Similarly, the right unranged signal on line 108 is fed to scalers 124, 126 and 128 whose outputs are fed to respective adjustable scalers 130, 132, and 134. Thus, the three right unranged signals are provided on three lines shown generally at 136. It will be noted that the signals on lines 122 and 136 represent the three pairs of unranged stereo signals, shown generally at 40 in FIG. 2.

Panning or movement of the sound image relative to the unranged signals can be accomplished by adjusting the variable scalers 116, 118, 120, 130, 132, and 134 together with the left-right differential provided by the delay buffer taps to control the amount of input signal fed to the respective azimuth placement filters 32, 34, and 36. Thus, each channel or voice is panned independently of any other input channel.

The ranged signal, so denoted because of its passage to the early reflection filters, is passed through a signal scalar 138 and then fed to a front left scalar 140, a front right scalar 142, a back left scalar 144, a back right scalar 146, a side left scalar 148, and a side right scalar 150. The output of these six scalars are fed respectively to variable scalars 152, 154, 156, 158, 160, and 162. As in the unranged signal, panning or movement relative to front, back, and side is accomplished by adjusting the variable scalars 152 through 162. Thus, the outputs from these variable ranged scalars on lines 164, 166, and 168 correspond to the ranged outputs shown generally at 42 from positioner 38 in FIG. 2.

FIG. 4 is a functional representation of an early reflection filter, such as shown at 44, 46, 48, of FIG. 2, and may be optimally structured by a delay line operating as a filter. Thus, in FIG. 4 left and right filters are shown that may be, in fact, a sixteen tap delay line in which the positive going spikes are in phase and the negative going spikes are out of phase. These in-phase, out-of-phase spikes occur in nature. Thus, the filter outputs are selected from the sixteen taps on the delay line based upon whether a positive or negative going spike is appropriate.

Therefore, it is seen from FIG. 2 that panning can be provided by specially constructed positioners that do not include any complicated filter arrangements but consist simply of scalars and delay lines, which are relatively inexpensive structures, all of which may be fed to a universal filter arrangement to provide the appropriate panning by controlling the scalars in the positioners, with an individual positioner being provided for each channel or voice of the system.

The above description is based on a preferred embodiment of the present invention, however, it will be apparent that modifications and variations thereof could be effected by one with skill in the art without departing from the spirit or scope of the invention, which is to be determined by the following claims.

What is claimed is:

1. Apparatus for positioning an apparent location of a sound source to a listener using headphones comprising:

positioner means producing from an input signal a plurality of ranged output signals and unranged output signals, said positioner means including variable signal scalars whose values are adjustable in response to a corresponding plurality of panning signals fed thereto for producing said plurality of output signals;

first sound positioning filter means receiving said unranged output signals from said positioner means and producing left and right output signals having an apparent sound source location outside the head of the listener selected in response to said panning signals;

second sound positioning filter means receiving said ranged output signals from said positioner means and producing left and right output signals having said apparent sound source location outside the head of the listener selected in response to said panning signals; and means for combining respective left and right output signals from said first and second sound positioning filter means and respectively producing left and right signals fed to respective left and right transducers of the headphone.

2. The apparatus according to claim 1, wherein said positioner means comprises a plurality of positioners, each receiving a respective, different input signal and each producing a respective plurality of ranged output signals and unranged output signals, said plurality of unranged output signals being fed to said first sound positioning filter means and said plurality of ranged output signals being fed to said second sound positioning filter means.

3. The apparatus according to claim 1, wherein said first sound positioning filter means comprises a front azimuth filter, a back azimuth filter, and a side azimuth filter for respectively locating an apparent sound source relative to a front location of the listener and said positioner means includes left front, back, and side variable scalars and right, front, back, and side variable scalars producing said unranged output signals fed respectively to said front azimuth filter, said back azimuth filter, and said side azimuth filter.

4. The apparatus of claim 3, wherein said positioner means further comprises a delay line receiving said input signal and producing at a first tap a left output signal fed to said left front, back and side variable scalars and at a second tap a right output signal fed to said right front, back, and side variable scalars.

5. The apparatus of claim 4, wherein said positioner means further comprises second left front, back, and side variable scalars and second right front back, and side variable scalars each receiving said input signal and producing respective ranged output signals fed to said second sound positioning filter means.

6. The apparatus of claim 5, wherein said second sound positioning filter means comprises front, back, and side early reflection filters receiving respectively said ranged output signals from said left front, back, and side variable scalars and said right front, back, and side variable scalars.

7. The apparatus of claim 1, wherein said ranged output signals from said positioner means add perceived distance ranging to the apparent sound source location outside the head of the listener.

8. Apparatus for causing an apparent location of a sound source to be selectively repositioned relative to a user of headphones reproducing signals corresponding to sounds from the sound source, comprising:

front, back and side sound placement azimuth filters each for producing respective left and right output signals fed to respective transducers of the headphones, and providing a selected apparent sound source position outside the head of the listener in response to signal levels of left and right signals fed respectively thereto;

front, back, and side early reflection sound placement filters each for producing respective left and right output signals fed to respective transducers of the headphones and providing a selected apparent sound source position outside the head of the listener in response to signal levels of left and right signals fed respectively thereto; and sound positioner means receiving input signals corresponding to sounds from the sound source fed to a plurality of variable scalars also receiving respective adjusting signals for adjusting levels of signals output from said variable scalars, the signals output from said variable scalars being fed respectively to said front back and side sound placement azimuth filters and to said front, back, and side early reflection filters.

9. Apparatus for positioning an apparent location of a sound source to a listener using transducers directed to the ears of the listener comprising:

a sound positioner receiving an audio input signal and producing a plurality of ranged output signals and unranged output signals, said sound positioner including variable signal scalars whose values are adjustable in response to a corresponding plurality of panning signals fed thereto for producing said plurality of output signals;

first filter means receiving said unranged output signals from said sound positioner and producing left and right output signals having an apparent sound source location located outside the head of the listener selected in response to said panning signals;

second filter means receiving said ranged output signals from said sound positioner and producing left and right output signals having said apparent sound source location selected in response to said panning signals; and means for combining respective left and right output signals from said first and second filter means and respectively producing left and right signals fed to respective ones of said transducers.

10. The apparatus according to claim 9, wherein said sound positioner comprises a plurality of positioners, each receiving a respective, different input signal and each producing a respective plurality of ranged output signals and unranged output signals, said plurality of unranged output signals being fed to said first filter means and said plurality of ranged output signals being fed to said second filter means.

11. The apparatus according to claim 9, wherein said first filter means comprises a front azimuth filter, a back azimuth filter, and a side azimuth filter for respectively locating an apparent sound source relative to a front location of the listener and said sound positioner includes left front, back, and side variable scalars and right front, back, and side variable scalars producing said unranged output signals fed respectively to said front azimuth filter, said back azimuth filter, and said side azimuth filter.

12. The apparatus of claim 11, wherein said sound positioner further comprises a delay line receiving said audio input signal and producing at a first tap a left output signal fed to said left front, back, and side variable scalars and at a second tap a right output signal fed to said right front, back, and side variable scalars.

13. The apparatus of claim 12, wherein said sound positioner further comprises second left front, back, and side variable scalars and second right front, back, and side variable scalars each receiving said input signal and producing respective ranged output signals fed to said second filter means.

14. The apparatus of claim 13, wherein said second filter means comprises front, back, and side early reflection filters receiving respectively said ranged output signals from said left front, back, and side variable scalars and said right front, back, and side variable scalars.

15. The apparatus of claim 9, wherein said ranged output signals from said sound positioner add perceived distance ranging to the apparent sound source location outside the head of the listener.

16. Apparatus for causing an apparent location of a sound source to be selectively repositioned relative to a listener of transducers arranged proximate the ears of the listener and that reproduce signals corresponding to sounds from the sound source, comprising:

front, back and side sound placement azimuth filters each for producing respective left and right output signals fed to respective ones of the transducers and providing a selected apparent sound source position outside of the head of the listener in response to signal levels of left and right signals fed respectively thereto;

front, back, and side early reflection sound placement filters each for producing respective left and right output signals fed to respective ones of the transducers and providing a selected apparent sound source position outside the head of the listener in response to signal levels of left and right signals fed respectively thereto; and a sound positioner receiving input signals corresponding to sounds from the sound source fed to a plurality of variable scalars also receiving respective adjusting signals for adjusting levels of signals output from said variable scalars, the signals output from said variable scalars being fed respectively to said front back and side sound placement azimuth filters and to said front, back, and side early reflection filters.

* * * * *